US006074051A

United States Patent [19]

Sasaki

[11] Patent Number: 6,074,051

[45] Date of Patent: Jun. 13, 2000

[54] INK CARTRIDGE

[75] Inventor: Toyonori Sasaki, Anjou, Japan

[73] Assignee: Brother Kogyo Kabushiki Kaisha, Nagoyo, Japan

[21] Appl. No.: 09/008,325

[22] Filed: Jan. 20, 1998

[30] Foreign Application Priority Data

Jan. 20, 1997 [JP] Japan ..... 9-022174

[51] Int. Cl.[7] ..... B41J 2/175

[52] U.S. Cl. ..... 347/86

[58] Field of Search ..... 347/84, 85, 86, 347/87

[56] References Cited

FOREIGN PATENT DOCUMENTS 6-255122 1/1994 Japan .

6-238908 8/1994 Japan .

*Primary Examiner*—N. Le
*Assistant Examiner*—Anh T. N. Vo
*Attorney, Agent, or Firm*—Oliff & Berridge, PLC

[57] ABSTRACT

An ink cartridge includes a cartridge case having a partition in it, which partitions its interior into an ink chamber and a storage chamber. The ink chamber contains ink, and the storage chamber contains a member impregnated with ink. The partition has an ink passage formed through it. The relationship between the width "w" of the passage and the width "d" of the storage chamber meets the expression $w \leqq d/2$. Even if gaps remain along edges of the storage chamber around the member, air bubbles are restrained from flowing from the gaps through the passage into the ink chamber.

13 Claims, 6 Drawing Sheets

INK CARTRIDGE

BACKGROUND OF THE INVENTION

1. Field of the Invention

The present invention relates to an ink cartridge having an ink chamber filled with ink and a storage chamber containing a porous member impregnated with ink. In particular, the invention relates to improvements in the ink passage between the ink chamber and the storage chamber.

2. Description of Related Art

In an ideal ink cartridge of this type, the ink in the storage chamber is first consumed through the ink passage and the ink chamber. Then, air is supplied from the storage chamber to the ink chamber, while ink in the ink chamber is consumed. The cartridge is connected to a recording head mounted on the carriage of a printer. Because the carriage reciprocates at high speed, the air in an upper portion of the ink chamber is formed into bubbles, which are liable to mix with the ink in this chamber. If air mixes with the ink, the recording performance of the printer lowers.

It is preferable that the porous member be fitted in close contact with the inner surfaces of the storage chamber without gaps. Actually, however, gaps or spaces remain along edges of the storage chamber around the porous member. The gaps are liable to be air passages.

Japanese Patent Laid-Open Publication No. H.6-238908 discloses a conventional ink cartridge in practical use for supplying ink to a recording head of an ink jet recorder. The cartridge includes a case partitioned into a liquid chamber and a storage chamber by a partition formed therebetween. The liquid chamber contains ink, and the storage chamber contains a porous member impregnated with ink. The liquid chamber has an ink supply hole, through which ink can be supplied to the head. The storage chamber has an air vent formed through its top wall. The partition between the chambers has a short ink passage formed through it at a predetermined height from its bottom. The passage is fitted with a filter on its side adjacent to the storage chamber. The filter can remove fine foreign substances produced mainly from the porous member.

The size, the shape, the position, etc. of the ink passage in this cartridge are neither disclosed nor suggested to prevent air from flowing from the storage chamber through the passage into the liquid chamber. The ink being sucked from the porous member into the liquid chamber is resisted higher than the air being sucked through the gaps along edges of the storage chamber, and through the passage into the liquid chamber. Therefore, if the passage is wide, air is liable to flow into the liquid chamber when ink in the cartridge is consumed and negative pressure develops in the liquid chamber. As a result, the ink in the porous member is difficult to supply to the liquid chamber. This lowers the ink consumption rate (ink consumption/amount of filled ink) of the cartridge. Besides, air may mix with the ink in the liquid chamber, thereby lowering the recording performance of the recording head. In particular, when the filter is clogged, and/or when the ink viscosity resistance is high at low temperature, the negative pressure in the liquid chamber may be high. If the negative pressure is high, a remarkable amount of air may flow into the liquid chamber.

Japanese Patent Laid-Open Publication No. H.6-255122 discloses another ink cartridge for supplying ink to a recording head of an ink jet recorder. The cartridge includes a case partitioned into a main ink storage chamber and an auxiliary ink storage chamber by a partition formed therebetween.

The main chamber contains ink, and the auxiliary chamber contains a porous member impregnated with ink. The main chamber has an ink supply hole formed through its bottom wall. The auxiliary chamber has an air vent formed through its top wall. The partition between the chambers has an ink passage formed through its bottom. The passage connects the chambers and is fitted with a filter.

When ink is supplied from the main ink storage chamber of this cartridge through the supply hole to the recording head, some negative pressure develops in this chamber. In the meantime, ink is supplied from the porous member in the auxiliary chamber through the passage to the main chamber, and air is introduced through the vent into the auxiliary chamber. While ink is flowing through the fine porous passages in the porous member, the ink is subjected to viscous (viscosity) resistance, capillary (capillarity) resistance, etc. If foreign substances stick to the filter, they resist the ink flowing through it. As a result, the negative pressure develops in the main chamber.

For the size, the shape, the position, etc. of the ink passage in this cartridge as well, nothing is disclosed to prevent air from flowing through the passage into the main ink storage chamber. In addition, the passage is positioned at the bottom of the partition, and extends nearly over the whole width of the auxiliary chamber. Therefore, air which has entered the gaps along edges of the auxiliary chamber flows easily into the main chamber. This prevents the ink in this cartridge, too, from being consumed ideally, thus lowering the ink consumption rate of the cartridge. The recording performance of the recording head is lowered by air mixing with the ink in the main chamber.

The inventors made an experiment with an ink cartridge of the type mentioned first. The experiment has proved that, if the distance between the ink passage and each of the edges of the storage chamber is too short, air is liable to flow from the gaps along edges into the passage. In addition, if the ink chamber is excessively large in comparison with the storage chamber, air is liable to mix with the ink in the ink chamber. This is not preferable in terms of recording performance.

SUMMARY OF THE INVENTION

It is an object of the invention to provide an ink cartridge of this type in which air is restrained from flowing into the ink chamber before a sufficient amount of ink in the storage chamber is consumed.

It is another object to provide an ink cartridge of this type which can supply a recording head stably with ink. It is a further object to provide an ink cartridge of this type which has a high ink consumption rate.

In accordance with the invention, an ink cartridge is provided, which includes a cartridge case. The case includes a partition therein which partitions the interior of the case into an ink chamber and a storage chamber. The partition has an ink passage formed therethrough. The relationship between the width "w" of the passage and the width "d" of the storage chamber satisfies the expression $w \leqq d/2$. The case has an ink supply hole through which the ink chamber communicates with the outside of the case. The case also has an air vent through which the storage chamber communicates with the outside of the case. The ink chamber is filled with ink. The storage chamber contains a member impregnated with ink.

The impregnated member in the storage chamber may be a foamed porous member. The ink cartridge may be used with an ink jet printer, which includes a carriage supporting a recording head. When mounted on the carriage, the cartridge is connected to the head. While ink is consumed at the head connected to the cartridge, ink in the ink chamber is supplied through the supply hole to the head. When ink is supplied from the ink chamber to the head, with the porous member impregnated with ink, some negative pressure develops in the ink chamber. In the meantime, ink is supplied from the porous member through the passage to the ink chamber, and air is introduced through the vent into the storage chamber.

As further ink is supplied through the supply hole to the recording head, ink in the porous member is consumed. When the ink level in the storage chamber has reached the ink passage, air in this chamber is introduced through the passage into the ink chamber, while ink in the ink chamber is consumed. Thus, the ink in the storage chamber is consumed through the passage and the ink chamber before the ink in the ink chamber is consumed. Thereafter, air in the storage chamber is supplied to the ink chamber, while ink in the ink chamber is consumed.

The porous member should be fitted in close contact with the inner surfaces of the storage chamber. Actually, however, gaps or spaces remain along edges of the storage chamber around the porous member. The gaps are liable to be air passages.

As stated above, the storage chamber is "d" in width. The ink passage is d/2 or less in width as also stated, and may be positioned near the bottom of the partition. Therefore, even though there are gaps along edges of the storage chamber, air (bubbles) is restrained from moving from the edges to the passage. As a result, less air is introduced through the gaps into the ink chamber by the negative pressure in this chamber before a sufficient amount of ink in the storage chamber is consumed.

It is therefore possible to consume ink in the cartridge ideally by consuming the ink in the storage chamber prior to the ink in the ink chamber. This can raise the ink consumption rate (ink consumption/amount of filled ink) of the cartridge. It is also possible to prevent a large amount of air from mixing with the ink in the ink chamber. This can supply ink stably to the recording head, thereby preventing the recording performance of the head from lowering.

The ink passage may be spaced at a distance which is d/4 or longer from each side wall of the storage chamber. The distance may be 2 mm or longer, and the passage may be 4 mm in width or narrower.

If the ink passage is positioned at the bottom of the partition, it is possible to raise the ink consumption rate for the following reason. When the ink in the cartridge has been consumed, the ink level in the storage chamber reaches the ink passage, and air is introduced from this chamber through the passage into the ink chamber. Therefore, by positioning the passage at the partition bottom, it is possible to consume ink in the storage chamber to the maximum.

The ink passage may otherwise be positioned at a predetermined height from the bottom of the partition. In this case, the passage is positioned away from the edge between the partition and the bottom of the storage chamber. As a result, air (bubbles) is restrained from flowing from the edge into the passage. The passage may be positioned at a height of about 1.5 mm from the partition bottom.

The ink passage may be rectangular in section in parallel to the partition, and greater in width than in height. In this case, it is possible to shorten the distance between the top of the passage and the bottom of the storage chamber. It is therefore possible to improve the ink consumption rate.

The ink passage may be positioned substantially in the middle of the partition between both side walls of the storage chamber. In this case, the passage is spaced at equal distances from the edges each between the partition and one of both side walls of the storage chamber. Consequently, air is restrained from flowing from both of the edges into the passage.

The ink chamber may be 0.5 cc or smaller in volume to restrain the ink in it from bubbling even while the carriage which supports the ink cartridge is moving at high speed. The volume ratio of the ink chamber to the storage chamber may be about 1/13 or less.

The partition may have an extension to the ink passage. The extension protrudes into the storage chamber. In this case, air can flow from the storage chamber through the extension and the passage into the ink chamber. Because the extension presses the member impregnated with ink, air is restrained from flowing into the pressed portion of the member around the extension. This restrains air from being introduced into the passage.

The ink cartridge is suitable for an ink jet printer. If the cartridge is used with an ink jet printer, the member impregnated with ink also functions to maintain the meniscuses of the printing head. Because all the ink in the member can be consumed, the cartridge is useful for this type of printer, and can stably supply ink to the recording head. In particular, the invention is suitable for a disposable cartridge.

BRIEF DESCRIPTION OF THE DRAWINGS

Preferred embodiments of the invention are shown in the accompanying drawings, in which.

DETAILED DESCRIPTION OF PREFERRED EMBODIMENTS

Figure 1:
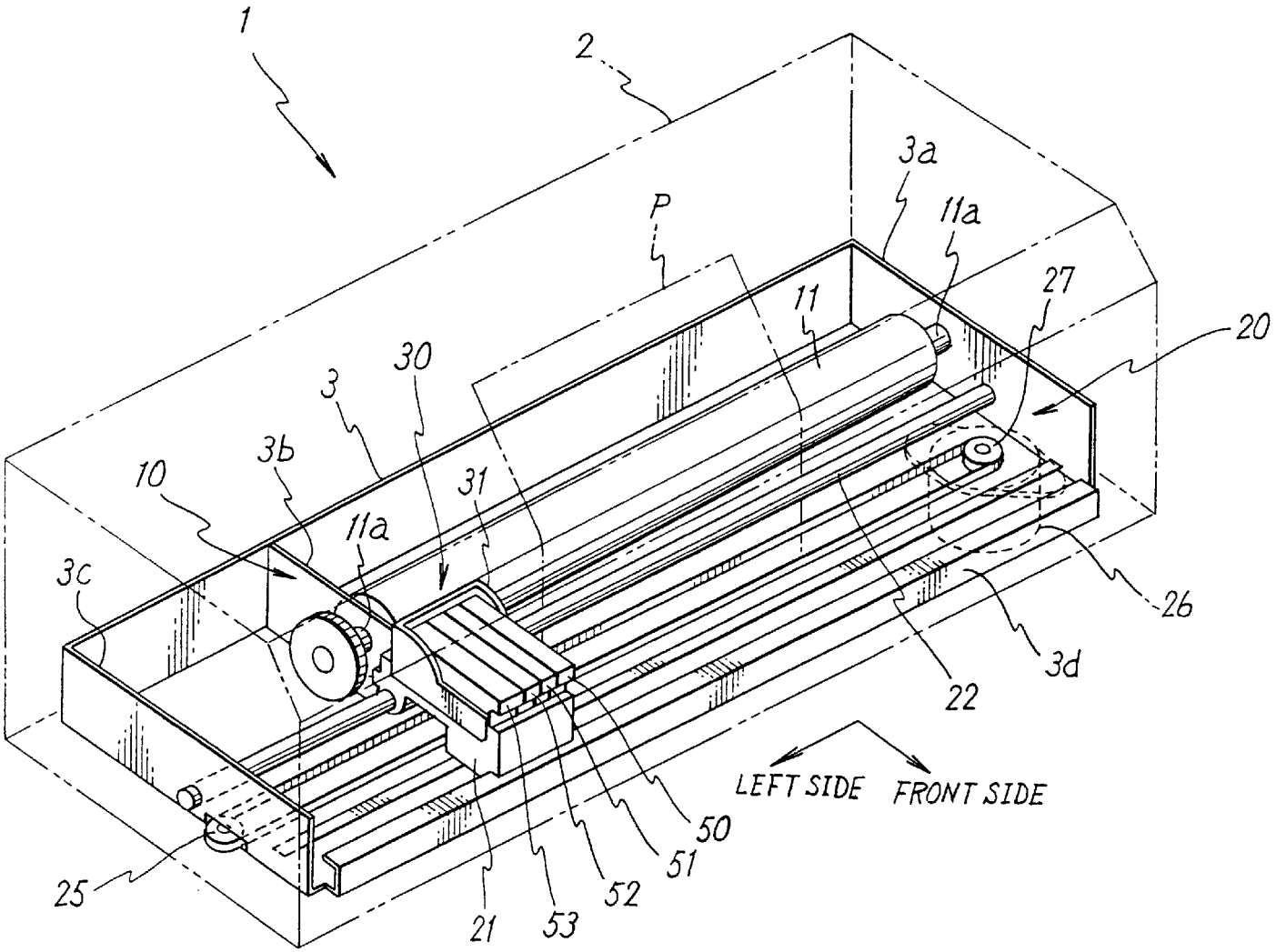
FIG. 1 is a perspective view of an ink jet recorder according to one of the embodiments.
Figure 2:
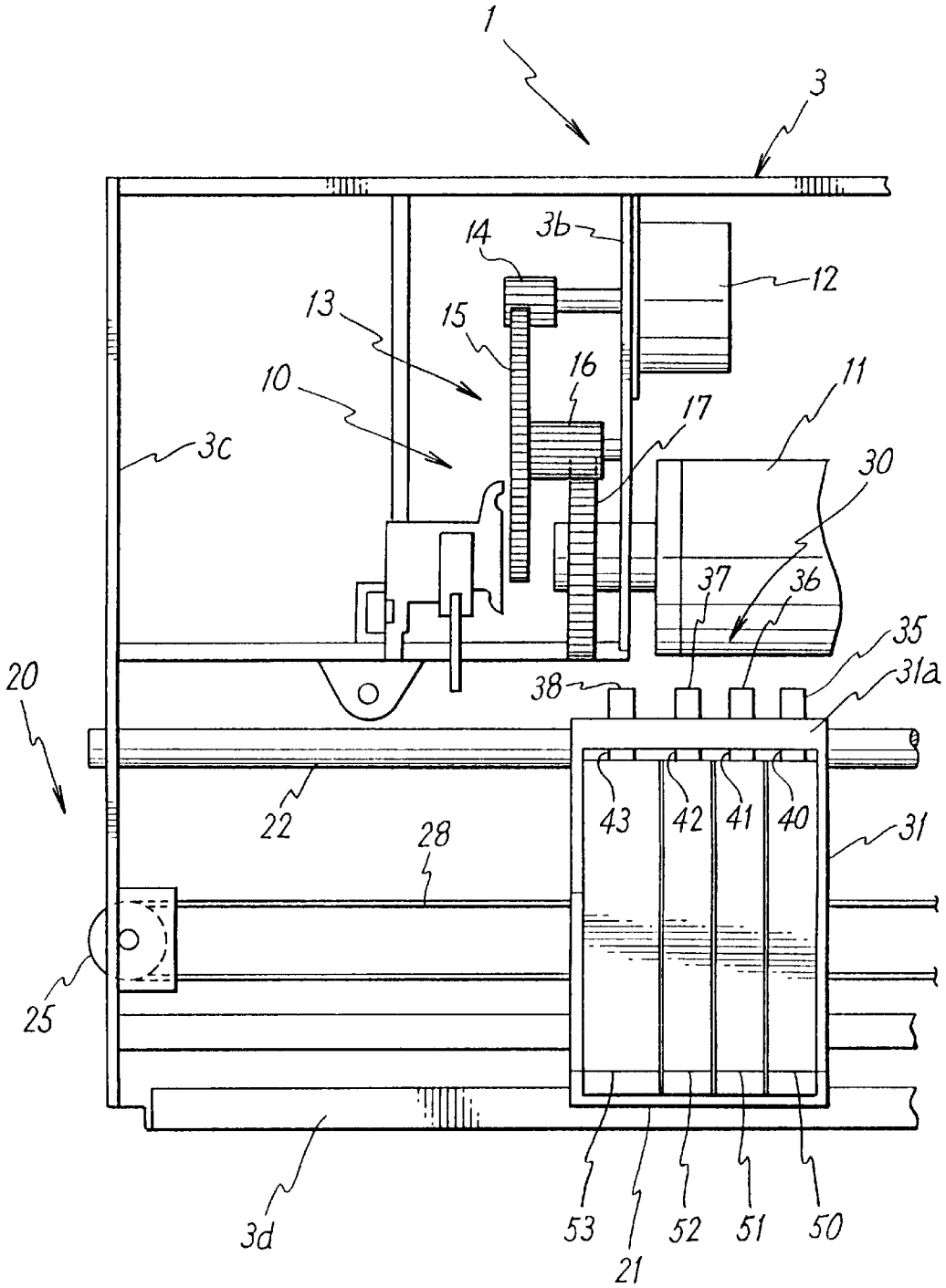
FIG. 2 is a partial top plan of the recorder shown in FIG. 1.

With reference to FIGS. 1 and 2, an ink jet recorder 1 according to an embodiment of the invention can print color images on recording paper P or another recording medium by ejecting a cyanogen ink (C: blue-green), a magenta ink (M), a yellow ink (Y) and a black ink (K). The recorder 1 includes a body frame 3 covered with a body cover 2. The frame 3 includes a vertical rear plate and vertical plates 3*a*, 3*b* and 3*c* extending perpendicularly to the rear plate. The frame 3 supports a paper feeder 10, a carriage drive 20 and a recording mechanism 30 for recording color images on a recording paper P.

The recording mechanism 30 includes a carriage 21, which supports a holder 31 fixed to its top and shaped like a box. Four ink cartridges 50–53 can be mounted removably on the holder 31. The cartridges 50–53 contain a cyanogen ink, a magenta ink, a yellow ink and a black ink, respectively.

The paper feeder 10 includes a platen 11 made of rubber. The platen 11 is fixed to a laterally extending horizontal shaft 11*a*, both ends of which are supported rotatably by the frame plates 3*a* and 3*b*. The plate 3*b* supports a feed motor 12, which can be driven by a control unit (not shown) to rotate the platen shaft 11*a* through a gear mechanism 13 consisting of gears 14–17.

The carriage drive 20 includes a guide rod 22 extending in front of and in parallel to the platen 11. Both ends of the rod 22 are fixed to the frame plates 3*a* and 3*c*. The frame 3 also includes a guide rail 3*d* formed at its front end in front of and in parallel to the rod 22. The carriage 21 is supported slidably on and along the rod 22 and the rail 3*d*.

The carriage drive 20 also includes a driven pulley 25 supported rotatably on the right (left in FIG. 2) end of the frame 3. The drive 20 further includes a stepping motor 26 mounted on a left end portion of the frame 3, and a drive pulley 27 fixed to the output shaft of this motor 26. An endless timing belt 28 runs between the pulleys 25 and 27, and is connected to the carriage 21. The control unit (not shown) can drive the motor 26 to move the carriage 21 right and left.

The holder 31 on the carriage 21 includes a rear wall 31*a*. Four recording heads 35–38 are fixed to the rear side of the wall 31*a*, and arranged horizontally side by side. The heads 35–38 are associated with the ink cartridges 50–53, respectively. Each of the heads 35–38 has jet nozzles (not shown) formed in it, which may be 64 in number. Each of the heads 35–38 includes a jet mechanism (not shown), which has piezoelectric elements, for ejecting ink out through the nozzles. Four ink supply pipes 40–43 are fixed to the holder wall 31*a*, extend through it and protrude forward from it. The pipes 40–43 are connected to the heads 35–38, respectively. As shown with the two dot chain lines in FIG. 3, the front end of each of the pipes 40–43 is fitted with a seal adapter 45. The rear end of each of the ink cartridges 50–53 is fitted with an adapter 85. When each of the cartridges 50–53 is mounted on the holder 31, the associated adapters 45 and 85 are connected together.

Because the ink cartridges 50–53 are basically identical in structure, only the cartridge 50 will be described below, representing all the cartridges. Exceptionally, because the cartridge 53 for the black ink is used more frequently, it is somewhat wider than the other cartridges.

As shown in FIGS. 3–6, the ink cartridge 50 includes a cartridge case 60 made of synthetic resin. The case 60 includes a body 61 which is open at its top and a lid 62 covering the top. The case body 61 includes a partition wall 63 extending perpendicularly to, and formed integrally with, both its side walls 61*a* and its bottom. The partition wall 63 partitions the interior of the case 60 into a rear chamber 65 and a front chamber 66. The volume ratio of the rear chamber 65 to the front chamber 66 is about 1:13 or less.

The rear chamber 65 is filled with ink I, and the front chamber 66 contains a porous member 68 impregnated with ink I. The porous member 68 may be sponge or other material having a mass or aggregation of air bubbles. The volume of ink with which the member 68 can be impregnated may be about 75% of the volume of this member. As shown in Table 1, the rear chamber 65 may contain 1.1 cc of ink, which is similar in volume to this chamber. The front chamber 66 (porous member 68) may be 14.5 cc in volume. As also shown, the front chamber 66 may contain 10.7 cc of ink, which is about 75% by volume of this chamber. In total, the cartridge 50 may contain 11.8 cc of ink.

TABLE 1

| | AMOUNT OF CONTAINED INK (cc) |
|---|---|
| REAR CHAMBER | 1.1 |
| FRONT CHAMBER | 10.7 (14.5) |
| REAR CHAMBER + FRONT CHAMBER | 11.8 |

The partition wall 63 has an ink passage 67 formed through it at its bottom to connect the chambers 65 and 66. Ink can flow through the passage 67 between the chambers 65 and 66.

Figure 3:
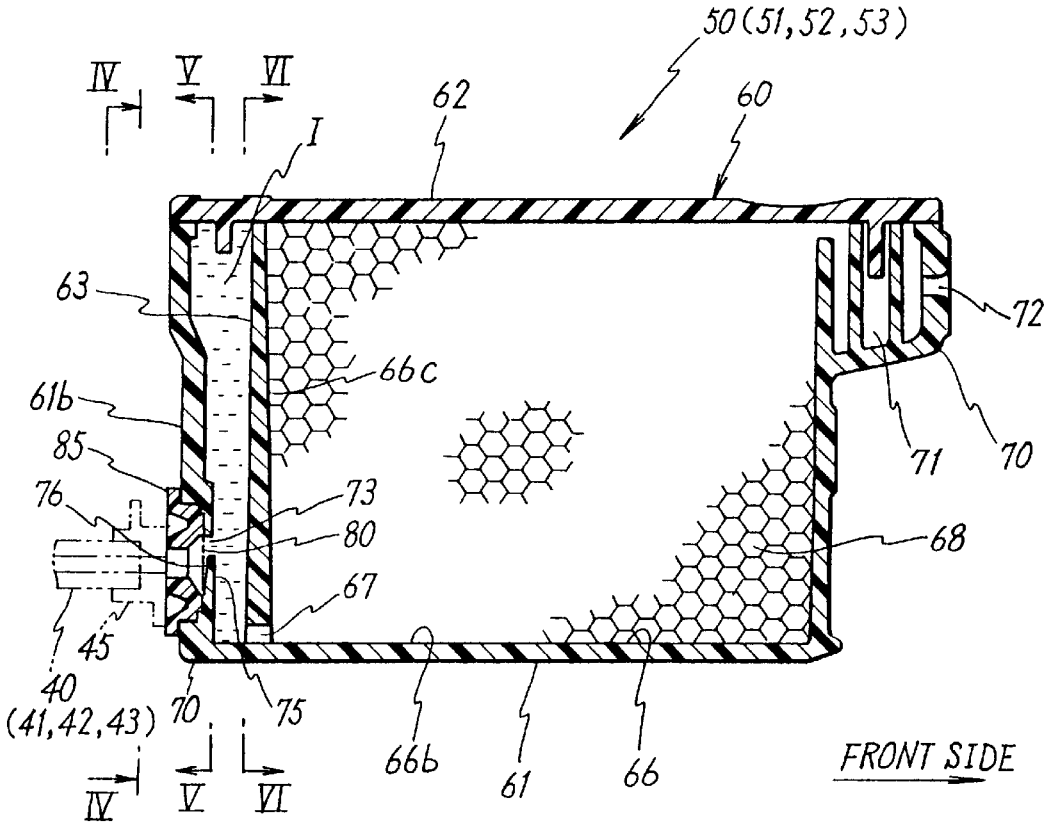
FIG. 3 is a longitudinal section of an ink cartridge of the recorder.
Figure 4:
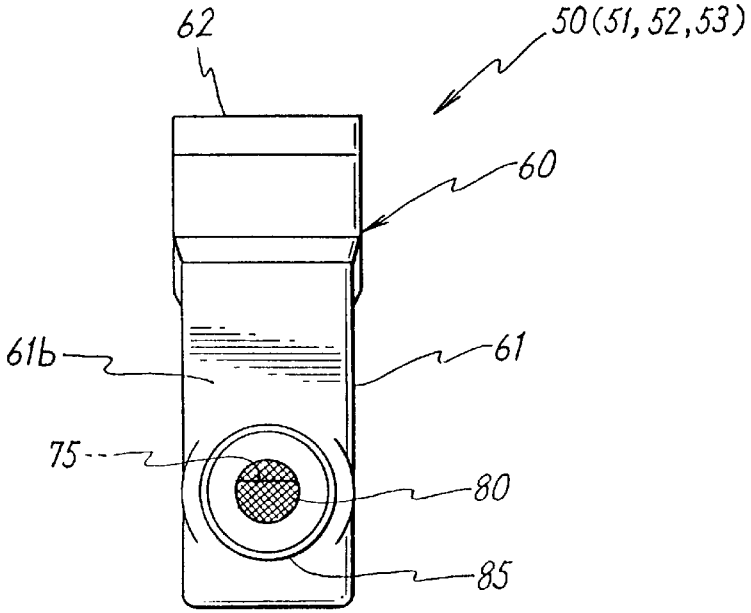
FIG. 4 is a rear view of the cartridge as taken along line IV—IV of FIG. 3.
Figure 6:
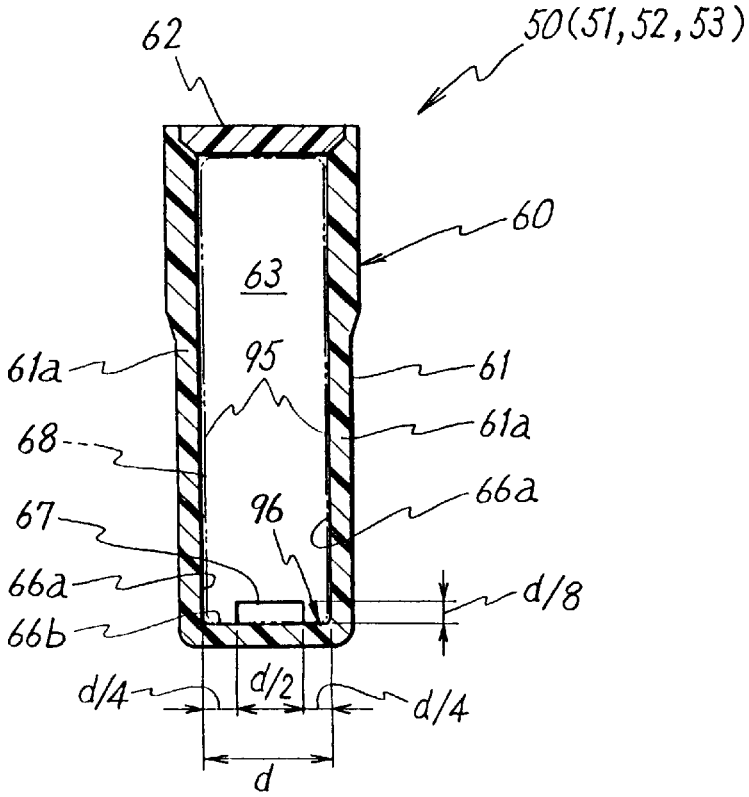
FIG. 6 is a cross section of the ink cartridge taken along line VI—VI of FIG. 3.

With reference to FIGS. 6 and 3, the width "d" of the chambers 65 and 66 may be 8 mm. As shown in FIG. 6, the ink passage 67 takes the form of a laterally wide rectangle in section in parallel with the wall 63. The rectangle is d/2 in width, which may be 4 mm, and d/8 in height, which may be 1 mm. The passage 67 is positioned in the middle of the partition wall 63 between the side walls 61*a*, and spaced at a distance of d/4 from each side surface 66*a* of the front chamber 66.

As shown in FIG. 3, the cartridge case 60 includes a handle 70 protruding forward from the top of its front end. The handle 70 can be held by one's fingers when the ink cartridge 50 is mounted on and removed from the holder 31. The handle 70 has an air passage 71 formed in it in the form of a maze and an air vent 72 formed through its front wall. The front chamber 66 communicates with the atmosphere through the passage 71 and the vent 72. Even if the side walls 61*a* of the case 60 are pressed, or the interior of the case 60 is pressurized otherwise, with the cartridge 50 filled with ink, it is possible to prevent the ink from leaking out by causing the ink in the front chamber 66 to flow into the air passage 71.

Figure 5:
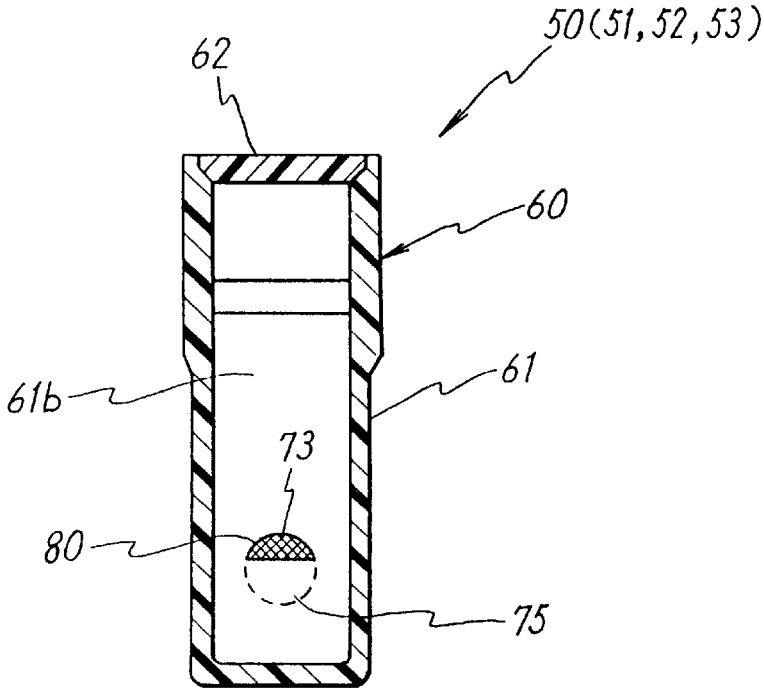
FIG. 5 is a cross section of the ink cartridge taken along line V—V of FIG. 3.

As shown in FIG. 3, the rear wall 61*b* of the cartridge case 60 has a recess 74 formed on its rear side near its bottom. As shown in FIGS. 3 and 5, the rear wall 61*b* also has an ink supply hole 73 formed through it in the center of the recess 74 to supply ink to the supply pipe 40. The outer end of the hole 73 is covered with a filter 80 made of stainless steel. The filter 80 is fixed by the adapter 85 being engaged with and welded to the recess 74. The microporous meshes of the filter 80 are finer than the cellular pores of the porous member 68. Therefore, when the cartridge 50 filled with ink is removed from the holder 31, the surface tension of the ink on the filter 80 prevents the ink in the cartridge 50 from leaking through the hole 73.

The rear wall 61*b* of the cartridge case 60 includes an ink rectifier 75 formed integrally with it for blocking a lower portion of the inner end of the ink supply hole 73. The rectifier 75 has a guide slope 76 formed on its rear side. When the cartridge 50 is made, the porous member 68 impregnated with no ink is squeezed into the case body 61, and then ink is supplied through the hole 73 to the rear chamber 65. The ink being supplied through the hole 73 is guided or directed by the rectifier slope 76 to an upper portion of the rear chamber 65. It is therefore possible to fill the rear chamber 65 with ink without air remaining in this chamber.

When the ink cartridge 50 is mounted on the holder 31, the adapter 85 around the ink supply hole 73 is engaged and connected with the seal adapter 45 on the supply pipe 40. Then, when ink is sucked from the cartridge 50 through the pipe 40 and the recording head 35 by a suction device (not shown), the ink fills both sides of the filter 80. As a result, no surface tension acts on the ink on the filter 80 any longer. This allows the ink in the rear chamber 65 to be supplied through the pipe 40 to the head 35. As ink is consumed at the head 35, ink is supplied from the rear chamber 65 through the hole 73, filter 80 and pipe 40 to the head 35.

When ink is supplied from the rear chamber 65 to the recording head 35, with the porous member 68 impregnated with ink, some negative pressure develops in the rear chamber 65. In the meantime, ink is supplied from the member 68 through the passage 67 to the rear chamber 65, and air is introduced through the vent 72 and the passage 71 into the front chamber 66. Because the front chamber 66 is exposed to the atmospheric pressure, the ink level in it lowers as ink is consumed. Because the top of the rear chamber 65 is closed with the lid 62, this chamber 65 is kept filled with ink while ink is consumed until the ink level in the front chamber 66 reaches the ink passage 67.

When the ink level in the front chamber 66 has reached the ink passage 67, air in this chamber 66 is introduced through the passage 67 into the rear chamber 65, while ink in the rear chamber 65 is consumed. In other words, the ink in the front chamber 66 is consumed through the passage 67 and the rear chamber 65 prior to the ink in the rear chamber 65. Thereafter, air in the front chamber 66 is supplied to the rear chamber 65, while ink in the rear chamber 65 is consumed.

The porous member 68 impregnated with ink should be fitted in close contact with the inner surfaces of the front chamber 66. Actually, however, gaps or spaces remain along edges 66*c* of the front chamber 66 around the member 68. The gaps are liable to be air passages.

It is ideal and most preferable that the ink in the front chamber be consumed prior to that in the rear chamber. However, because the ink in the conventional cartridges is not consumed in such an ideal manner, their ink consumption rates (ink consumption/amount of filled ink) are very low for the following reason.

Although the porous member in the front chamber of each conventional cartridge is impregnated with ink, air in this chamber flows into the rear chamber. Consequently, ink in the rear chamber is consumed and the ink remaining in this chamber decreases. In the meantime, ink is difficult to supply from the porous member to the rear chamber and remains in the front chamber.

Therefore, the inventors speculated that the ink consumption rate of the ink cartridge 50 might be related to the distance between the ink passage 67 and each edge 66*c* of the front chamber 66. Then, the inventors made sample cartridges like the cartridge 60. The width "d" of the front chamber (66) of each sample cartridge was 8 mm. The ink passages (67) of the partition walls (63) differed in width. Ink consumption rates P (ink consumption/amount of filled ink×100) were measured for these cartridges.

Table 2 shows the results of the experiment. For the passage width of 8 mm, the ink consumption rates P were as very low as 30–45%. Even for the widths of 7 mm and 5 mm, the rates P were as not very high as 50–65% and 55–70%, respectively. For the widths of 4 mm, 2.5 mm and 2 mm, the rates P were as high as 70–85%, 75–85% and 75–85%, respectively. For the widths of 2.5 mm and 2 mm, the remaining 15–25% of the filled ink was the ink dispersed finely in the porous member (68) and remaining there due to capillarity.

TABLE 2

| INK PASSAGE WIDTH (mm) | INK CONSUMPTION RATE P (%) |
|---|---|
| 8 | 30–45 |
| 7 | 50–65 |
| 5 | 55–70 |
| 4 | 70–85 |
| 2.5 | 75–85 |
| 2 | 75–85 |

This experiment has proved that, if the distance between the ink passage and each edge of the front chamber is too short, air is liable to flow through the gaps along the edges into the passage, thereby lowering the ink consumption rate P. It has also been proved that, if the passage width is 4 mm or narrower, that is to say, if the passage is spaced at a distance of d/4 (2 mm) or farther from each side surface of the front chamber, air does not easily flow through the gaps along the edges into the passage, thereby raising the consumption rate P.

As stated already, the ink passage 67 of this embodiment is d/2 in width, and spaced at a distance of d/4 from each side surface 66*a* of the front chamber 66.

As stated above, the ink cartridge 50 has a rear chamber 65 and a front chamber 66 on both sides of a partition wall 63. The wall 63 has an ink passage 67 formed through it at its bottom. The front chamber 66 has a width "d" between both its side surfaces 66*a*. The passage 67 is spaced at a distance of d/4 from each side surface 66*a*. This makes it possible to restrain air from flowing through the gaps 95 (FIG. 6) along the edges 66*c* into the passage 67 and being supplied to the rear chamber 65 before a sufficient amount of ink in the front chamber 66 is consumed.

It is therefore possible to consume ink in the cartridge 50 ideally by consuming ink in the front chamber 66 prior to the ink in the rear chamber 65. This can raise the ink consumption rate P (ink consumption/amount of filled ink) of the cartridge 50. It is also possible to prevent a large amount of air from mixing with the ink in the rear chamber 65. This can supply ink stably to the recording head 35, thereby preventing the recording performance of the head from lowering.

The ink passage 67 is positioned at the bottom of the partition wall 63. Therefore, when the ink level in the porous member 68 has reached the passage 67, so that air in the front chamber 66 is introduced through the passage 67 into the rear chamber 65, a sufficient amount of ink in the front chamber 66 has been consumed. This can remarkably raise the ink consumption rate P.

The ink passage 67 is laterally wide and rectangular. Therefore, the passage 67 can have a proper width, which depends on conditions such as the flow velocity of the ink flowing through the passage. In addition, it is possible to lower the height of the passage 67, which is the distance between the bottom 66*b* of the front chamber 66 and the top of the passage 67. It is therefore possible to raise the ink consumption rate P.

The rear chamber 65 is sufficiently small in volume as compared with the front chamber 66. The volume ratio of the rear chamber 65 to the front chamber 66 may be 1:13 or less. Accordingly, the front chamber 66 contains much more ink than the rear chamber 65. Therefore, most of the ink in the cartridge 50 is supplied to the recording head 35 in such condition that ink can be supplied from the front chamber 66 to the rear chamber 65, that is to say, such condition that the rear chamber 65 is filled with ink. It is consequently possible to supply ink stably to the head 35, without air mixing with the ink in the rear chamber 65.

The rear chamber 65 is very small in volume (1.1 cc). Therefore, even if air in the front chamber 66 is introduced into the rear chamber 65 after the ink in the front chamber 66 is consumed or even before it has been, the ink in the rear chamber 65 is restrained from bubbling even when the carriage 21, on which the cartridge 50 is mounted, reciprocates at high speed. As a result, air is not liable to mix with the ink in the rear chamber 65. It is therefore possible to supply ink stably to the recording head 35.

Thus, air is prevented from flowing into the rear chamber 65 before a sufficient amount of ink in the front chamber 66 is consumed. Therefore, by applying the ink cartridges 50–53 to an ink jet recorder for printing a sheet of recording paper by ejecting ink onto the sheet, it is possible to supply ink stably to the recording heads of the printer, and to raise the ink consumption rate.

Figure 7:
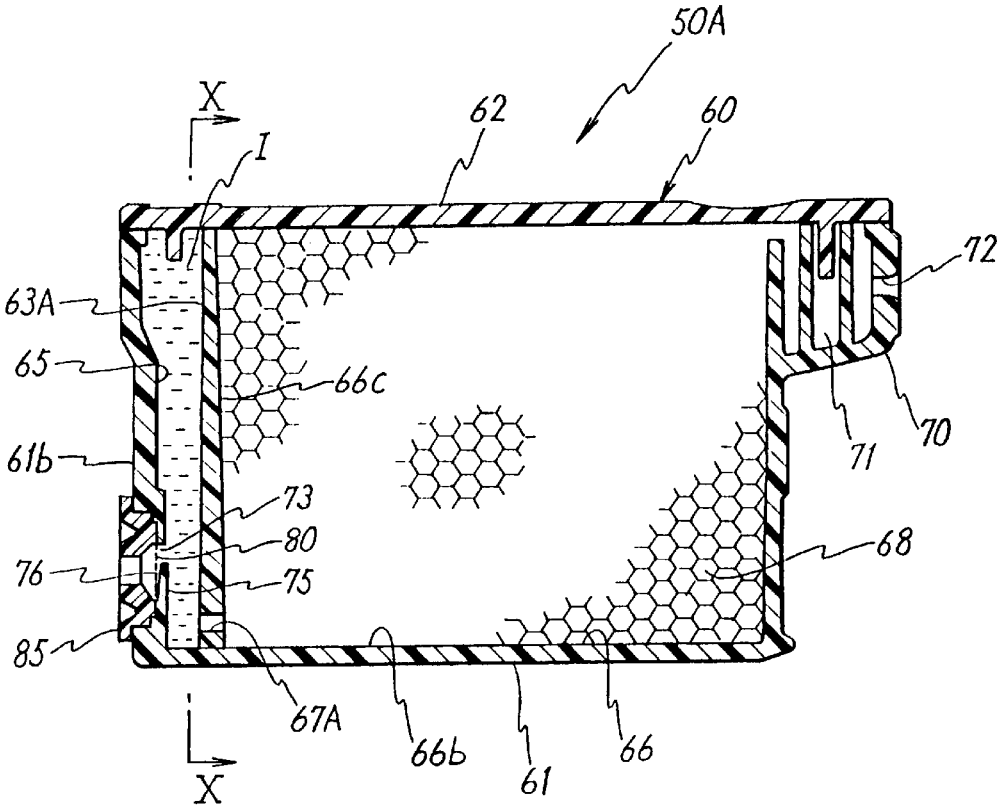
FIG. 7 is a longitudinal section of an ink cartridge according to another embodiment.
Figure 8:
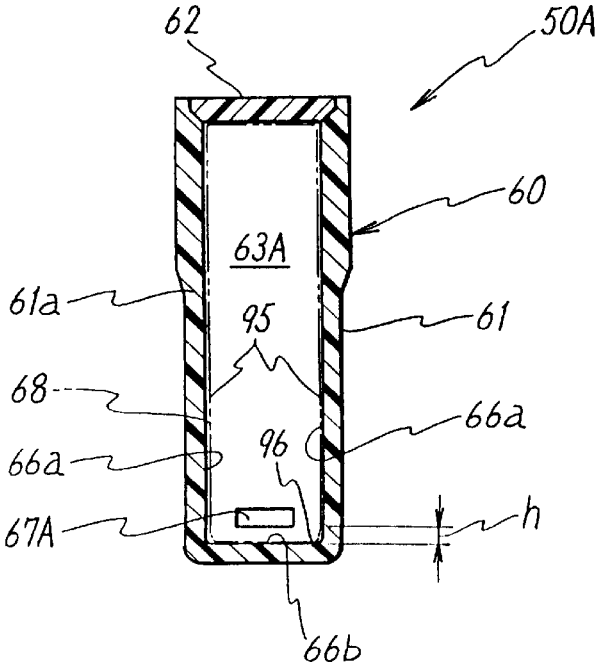
FIG. 8 is a cross section taken along line X—X of FIG. 7.
Figure 9:
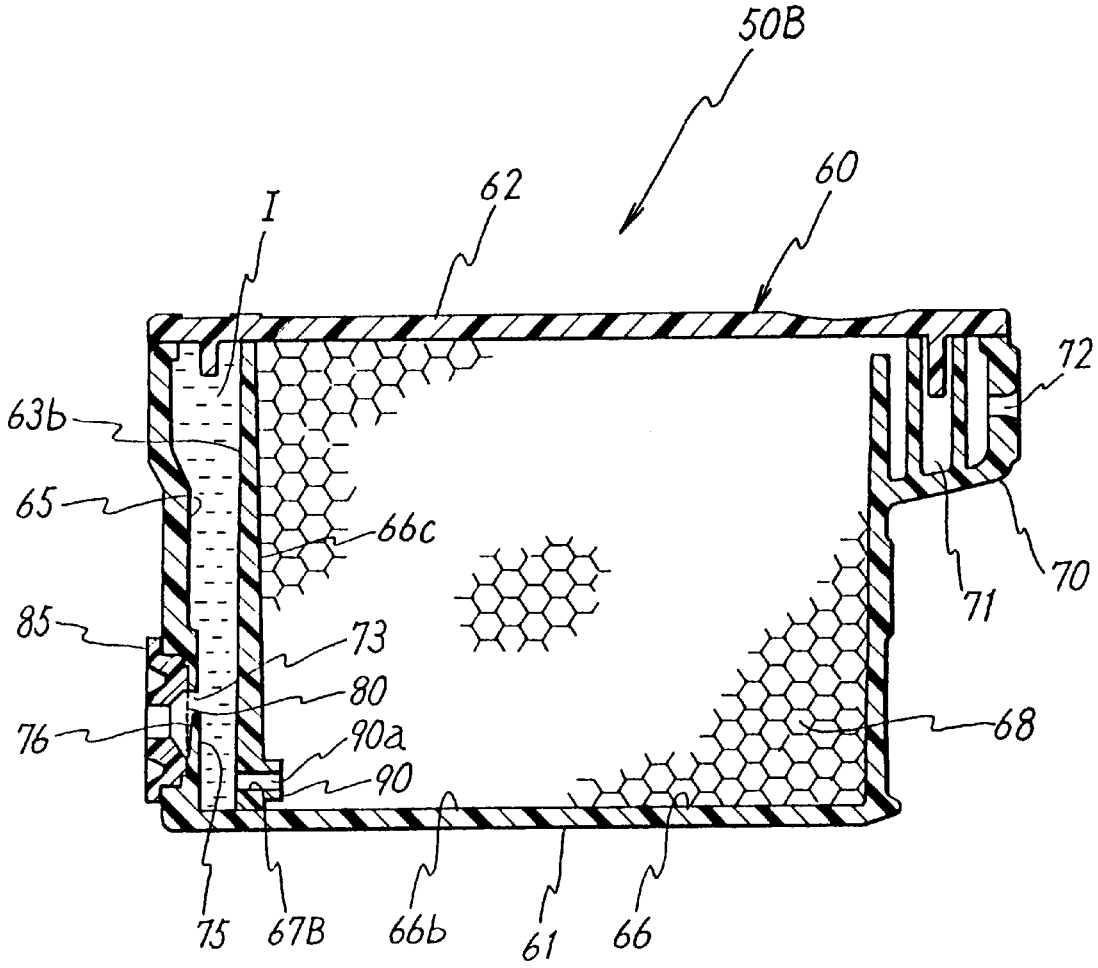
FIG. 9 is a longitudinal section of an ink cartridge according to a further embodiment.

FIGS. 7, 8 and 9 show modified ink cartridges according to the invention, which are substantially identical in shape and size with the cartridge 50. In FIGS. 7–9, parts which are equivalent to those of the cartridge 50 are assigned the same numerals to avoid repeating the descriptions.

The ink cartridge 50A shown in FIGS. 7 and 8 includes a partition wall 63A, which has an ink passage 67A formed through it. The passage 67A is spaced at a predetermined height "h", which may be 1.5 mm, from the bottom of the wall 63A. The front chamber 66 has a width "d". The passage 67A takes the form of a laterally wide rectangle in section in parallel with the wall 63A. The passage 67A is d/2 in width, d/8 in height, and spaced at a distance of d/4 from each side surface 66*a* of the front chamber 66.

The ink cartridge 50A has functions and effects which are similar to those of the cartridge 50. In addition, the ink passage 67A can be positioned away from the lower edge of the front chamber 66 which is adjacent to the partition 63A. It is therefore possible to restrain air securely from flowing through the gap 96 between the lower edge and the porous member 68 into the passage 67A.

The ink cartridge 50B shown in FIG. 9 includes a partition wall 63B, which is similar to the wall 63A of FIGS. 7 and 8. The wall 63B has an ink passage 67B formed through it. The passage 67B is positioned and sized the same as the passage 67A of the cartridge 50A. In addition, the wall 63B includes a port 90 protruding slightly from it into the front chamber 66. The port 90 has a passage 90*a* formed through it and communicating with the passage 67B. The passage 90*a* is equal in height and width to the passage 67B, and aligned with it.

The ink cartridge 50B has functions and effects which are similar to those of the cartridge 50A shown in FIGS. 7 and 8. Ink flows from the porous member 68 through the passages 90*a* and 67B into the rear chamber 65. Because the port 90 is in close contact with the member 68, air is restrained securely from flowing into the passages 90*a* and 67B through the gaps 95 and 96 where the member 68 is out of close contact with the edges of the front chamber 66.

The invention has been described in the specific forms, but may be embodied in other forms without departing from the spirit or essential characteristics thereof. For example, the ink cartridges 50, 50A and 50B may be modified further as follows:

1) Each of the ink passages 67, 67A and 67B might be narrower than d/2 (for example, 2.5 or 2 mm), and spaced at a distance longer than d/4 from each side surface 66*a* of the front chamber 66.

2) Each of the partitions 63, 63A and 63B might have two or more ink passages spaced at a distance longer than d/4 from both side surfaces 66*a* of the front chamber 66.

3) The ink passages 67, 67A and 67B might not be rectangular, but might be circular, oval or shaped otherwise in section in parallel with the partitions 63, 63A and 63B, respectively.

4) The edges of at least the front chamber 66 might be rounded or curved so that the porous member 68 might closely contact the whole inner surface of this chamber. In this case, no gap is formed between the member 68 and the inner surface of the chamber 66. Therefore, with the member 68 impregnated with ink, the air in the front chamber 66 is prevented securely from flowing through the passage 67, 67A or 67B into the rear chamber 65.

5) Each of the ink cartridges 50, 50A and 50B is shown and has been described as positioned with the axis of its ink supply hole 73 horizontal, but might be used with the hole axis vertical or at an angle of about 45 degrees between the horizontal and vertical.

What is claimed is:

1. An ink cartridge comprising:

a cartridge case including a partition therein having a width and a thickness which partitions the interior of the case into an ink chamber and a storage chamber, the case having an ink supply hole through which the ink chamber communicates with the outside of the case, the case also having an air vent through which the storage chamber communicates with the outside of the case;

a member which is impregnated with ink, the member being housed in the storage chamber; and ink with which the chambers are filled, wherein the partition has an ink passage formed through the thickness of the passage, the passage and the partition having widths "w" and "d", respectively, parallel with the partition width, the passage width "w" being not more than d/2.

2. The ink cartridge defined in claim 1, wherein the ink passage is spaced at a distance which is at least d/4 from each side wall of the partition.

3. The ink cartridge defined in claim 2, wherein the width "w" of the ink passage is not more than 4 mm and the distance from the side wall of the partition is at least 2 mm.

4. The ink cartridge defined in claim 1, wherein the ink passage is positioned at the lower end of the partition.

5. The ink cartridge defined in claim 1, wherein the ink passage is positioned at a predetermined height from the lower end of the partition.

6. The ink cartridge defined in claim 5, wherein the height is about 1.5 mm.

7. The ink cartridge defined in claim 1, wherein the ink passage takes the form of a rectangle parallel with the partition width, the rectangle having a height "h" which is smaller than the width "w" of the passage.

8. The ink cartridge defined in claim 1, wherein the ink passage is positioned substantially in the middle of the width of the partition.

9. The ink cartridge defined in claim 1, wherein the ink chamber is not more than 0.5 cc in volume.

10. The ink cartridge defined in claim 9, wherein the volume ratio of the ink chamber to the storage chamber is not less than about 1/13.

11. The ink cartridge defined in claim 1, wherein the partition has an extension to the ink passage, the extension protruding into the storage chamber.

12. The ink cartridge defined in claim 1 for use with an ink jet printer.

13. The ink cartridge defined in claim 1, which is a disposable cartridge.

* * * * *

UNITED STATES PATENT AND TRADEMARK OFFICE

CERTIFICATE OF CORRECTION

PATENT NO. : 6,074,051
DATED : June 13, 2000
INVENTOR(S) : Toyonori SASAKI

It is certified that error appears in the above-indentified patent and that said Letters Patent is hereby corrected as shown below:

Please change the Assignee's city of address from "Nagoyo" to --Nagoya--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*